United States Patent [19]

Mott

[11] 3,939,913

[45] Feb. 24, 1976

[54] METHOD OF USING A SUBSURFACE SAFETY VALVE

[75] Inventor: James D. Mott, Houston, Tex.

[73] Assignee: Hydril Company, Houston, Tex.

[22] Filed: Nov. 4, 1974

[21] Appl. No.: 520,847

Related U.S. Application Data

[60] Continuation of Ser. No. 362,784, May 22, 1973, abandoned, which is a division of Ser. No. 131,710, April 6, 1971, Pat. No. 3,750,751.

[52] U.S. Cl. ..... 166/314; 166/315

[51] Int. Cl.[2] ..... E21B 43/12; E21B 43/01

[58] Field of Search ..... 166/72, 68, 224 S, 224 A, 166/314, 315

[56] References Cited

UNITED STATES PATENTS

| | | | |
|---|---|---|---|
| 3,675,720 | 7/1972 | Sizer | 166/314 |
| 3,696,868 | 10/1972 | Taylor | 166/315 |

*Primary Examiner*—Stephen J. Novosad
*Assistant Examiner*—George A. Suckfield
*Attorney, Agent, or Firm*—Pravel & Wilson

[57] ABSTRACT

A pressure operated safety valve adapted to be mounted in a well tubing, which may be moved to open or closed positions independently of pressure in the tubing and locked in and unlocked from the open position using control fluid pressure.

20 Claims, 9 Drawing Figures

17
22a
23a
22
23
25
26
H
31
12
32
38
27
30
36c
36b
36
36d
29
4
4
36a
35b
35
33b
28b
28
28a
33
28a
12b
12a
34
34a
33a
39
37
41
40
42
15a
15
16
12
30a
65
67
62a
62
68
63
90
91
96
86
80
B
75
77a
77
78
74
19
20
20a
21

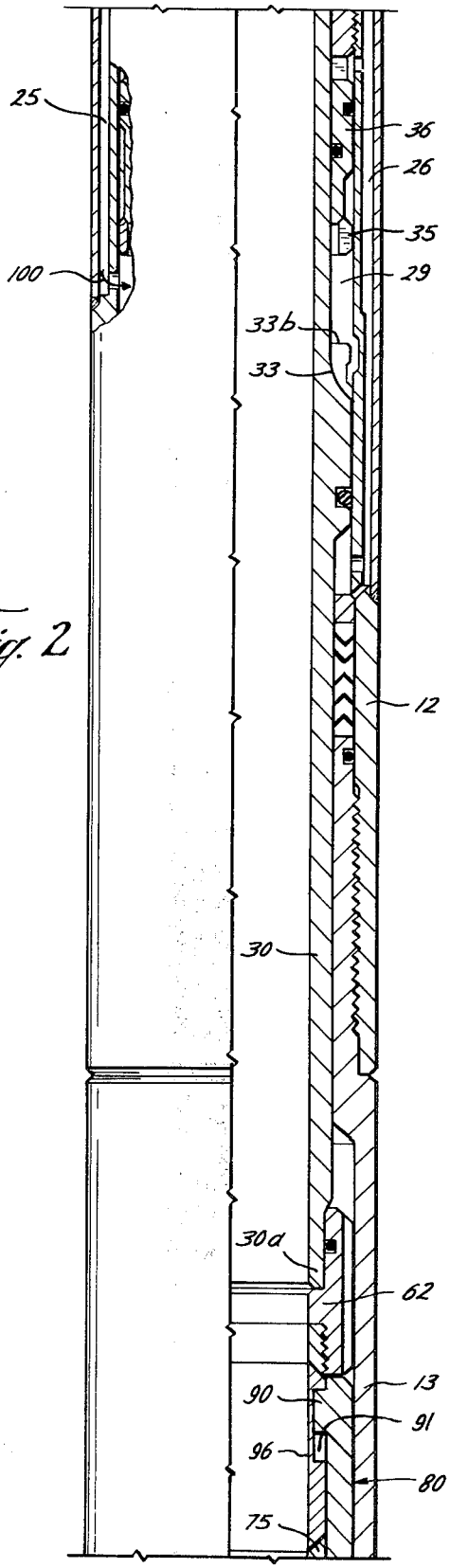
Fig. 2
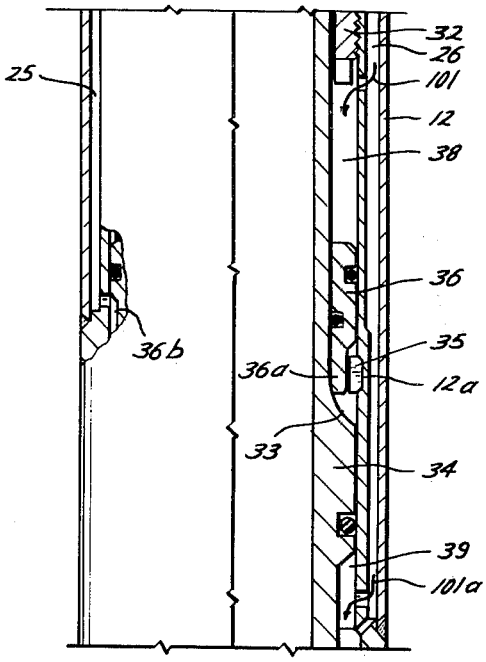
Fig. 3
Fig. 4
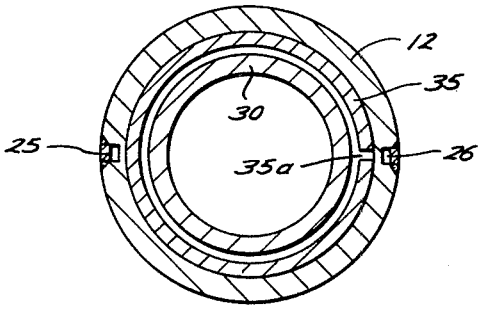

METHOD OF USING A SUBSURFACE SAFETY VALVE

CROSS-REFERENCE TO RELATED APPLICATIONS

This is a continuation of application Ser. No. 362,784 filed May 22, 1973, now abandoned, which was a division of Ser. No. 171,710, filed Apr. 6, 1971 now U.S. Pat. No. 3,750,751.

The subject matter of the present application may be used in well tubing, as can the valves in my prior copending U.S. patent application "Subsurface Safety Valve with Lock means," Ser. No. 72,034, filed Sept. 14, 1970, now abandoned.

BACKGROUND OF THE INVENTION

1. Field of the Invention

The present invention relates to pressure operated safety valves for disposition in well tubing.

2. Description of the Prior Art

In the past, it has been the practice to use devices in producing wells, particularly offshore wells, which automatically close when the well pressure reaches a predetermined amount for the purpose of preventing well blowouts and the resultant fires and pollution of the sea with oil.

The most common type has been marketed under the name "storm" choke, but it is not as widely used as it should be because it is generally damaged by sand or other abrasives flowing therethrough with the oil during normal production, so that it is not operative for preventing blowouts when they occur.

Ball-type safety valves, examples of which are found in U.S. Pat. Nos. 2,894,715; Re25,471; 2,998,070; 3,035,808; 3,126,908 3,189,044 and 3,059,913 have also been used in an attempt to provide automatic closing of wells to prevent well blowouts. However, even the best of the safety valves are subject to malfunctioning, particularly after having been left in a well for a period of time. Since the government requires periodic testing of the safety valves, those that are defective can be located, but with the previously known valves, even if they were found to be defective, nothing could be done to immobilize or replace the defective valve, short of shutting down the well and attempting a removal of the defective valve with all of the attendant problems.

SUMMARY OF THE INVENTION

Briefly, the present invention provides a new and improved safety valve for controlling flow through a well tubing wherein fluid pressure is controlled in a plurality of expansible chambers formed between a housing in the well tubing and an operating sleeve which controls the position of a ball-type valve. Differential fluid pressures are formed between the plural chambers to cause relative movement between the operating sleeve and the housing controlling the position of the valve to regulate and control flow through the well tubing independently of the pressure in the well tubing. Plural fluid conduits, each of which individually conveys fluid to one of the chambers, provide alternate fluid supply to the valves and thus prevent failure of fluid supply to one of said conduit means from rendering the valve inoperable. A locking piston mounted between the housing and the operating sleeve moves a locking detent into a locking recess formed in the housing in response to fluid pressure in one of the expansible fluid chambers in order to lock the operating sleeve in a position maintaining the valve in an open position when it is desired to retain the valve in such position.

It is an object of the present invention to provide a new and improved subsurface safety valve.

It is an object of the present invention to provide a new and improved safety valve for use in a well tubing which may be moved open or closed independently of the pressure in the well tubing.

It is an object of the present invention to provide a new and improved fluid operated safety valve which is not rendered inoperable if a fluid supply conduit for such valve should fail.

It is an object of the present invention to provide a new and improved safety valve for well tubing which may be locked in and unlocked from an open position.

BRIEF DESCRIPTION OF THE DRAWINGS

FIG. 2 is an elevation of the valve in FIGS. 1A and 1B, but showing the parts thereof in different positions;

FIG. 3 is an elevation of the valve of FIGS. 1A, 1B and 2, but showing the parts in different positions;

FIG. 4 is a cross-sectional view, taken along the line of 4—4 of FIG. 1A;

DESCRIPTION OF THE PREFERRED EMBODIMENT

Figures 1A, 1B:
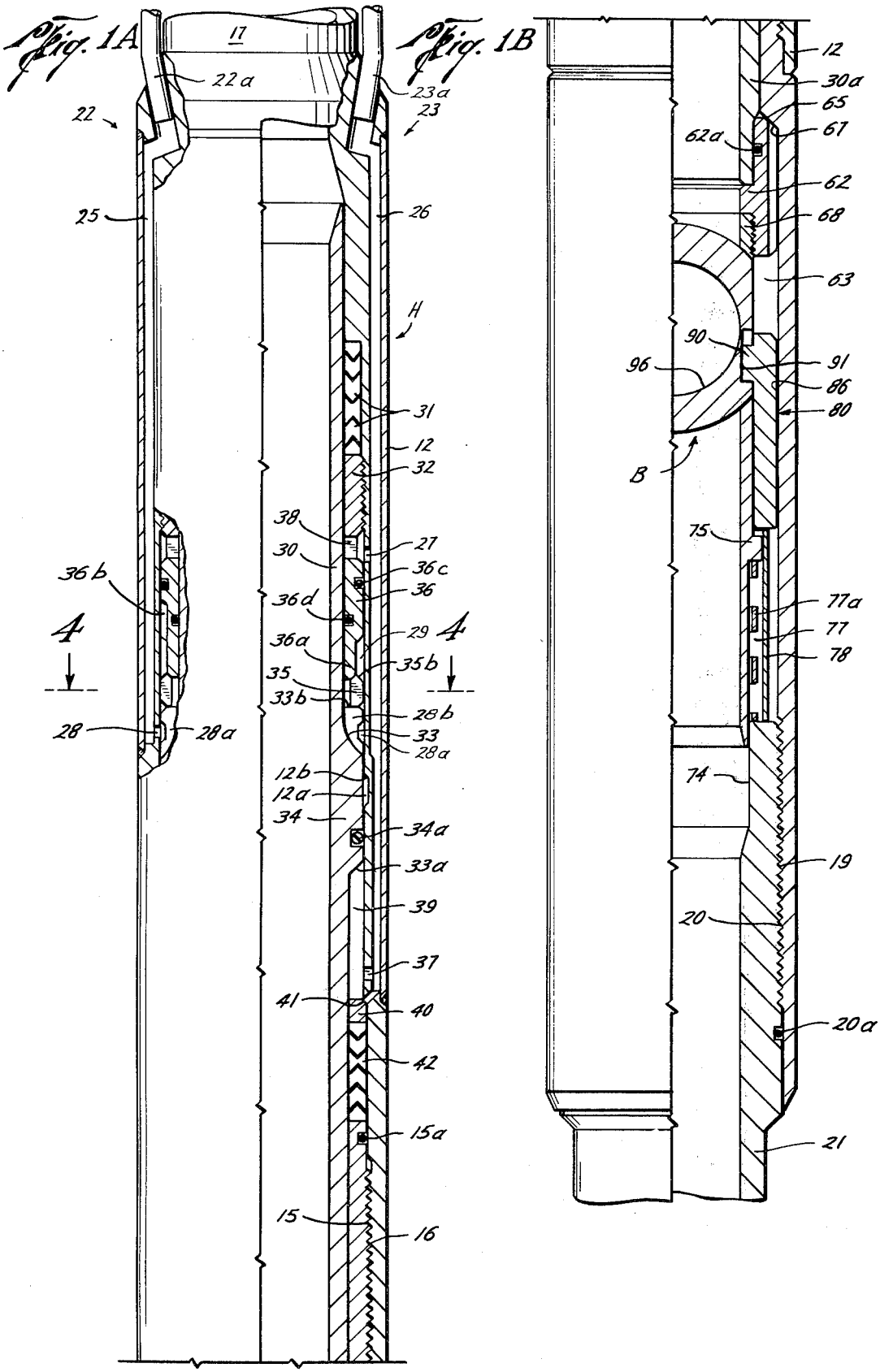
FIG. 1A is an elevation, partly in section, of an upper portion of the safety valve of the present invention.
FIG. 1B is an elevation, partly in section, of a lower portion of the safety valve of the present invention.

The safety valve of this invention has a housing H which includes two sections 12 and 13, coupled together at threads 15 and 16, and provided with an O-ring seal 15*a*. The upper housing section 12 terminates in an adapter 17 having a threaded box for attachment in a tubing string thereabove, not shown. At the lower end of lower housing section 13, female threads are provided for threaded engagement with male threads 20 on an adapter 21 having external threads at its lower extremity for attachment to a section of the tubing string therebelow (not shown). An O-ring seal 20*a* is provided between the adapter 21 and the housing section 13. One or more set screws 20*b* may be provided to prevent an inadvertent release of the threaded connection 19, 20.

The wall of the top housing section 12 (FIG. 1A) has a plurality of conduits including a first conduit or operating conduit 22 including a longitudinally formed operating passage 25 terminating in a threaded fitting or inlet socket for attachment of a hose or pipe 22*a* leading to the ground level or surface. The passage 25 connects through a port 28, an annular groove 28*a* and a longitudinal passage 28*b* (FIG. 1A) with an expansible operating chamber 29 between the section 12 and an operating sleeve 30 slidably received in the housing H. A locking detent or resilient metal split or snap ring 35 and a reduced nose or end portion 36*a* of locking piston 36 normally bearing against the snap-ring 35 along a beveled edge form one end of the chamber 29, while the other end of the chamber is formed by an inclined shoulder 33 on an annular collar 34 formed on the sleeve 30. The snap-ring 35 is resilient and engages an inner surface of the section 12. The snap ring 35 expands outwardly increasing the size of a slot 35*a* (FIG. 4) formed therein, to engage the walls of a locking recess 12*a* formed in the interior surface of the section 12. A lower surface of the locking detent 35 engages a shoulder surface 33*b* of the sleeve 30 adjacent the inclined wall 33 for causing downward movement of the sleeve 30, as will be more evident hereinbelow.

A slot or longitudinal groove 36*b* is formed in the locking piston 36 on a surface adjacent the portion of section 12 in which the control passage 25 is formed. The slot 36*b* permits fluid communication from the control passage 25 and the port 28 to the chamber 29 when the piston 36 is to be moved upwardly, as will be set forth hereinbelow. The locking piston 36 carries O-rings 36*c* and 36*d* to provide a seal between the locking piston 36 and the upper section 12 and sleeve 30, respectively.

The collar 34 slidably engages the inner wall of housing section 12 and is provided with a sealing O-ring 34*a*.

A second expansible locking chamber 38 between the sleeve 30 and the section 12 above the piston 36 communicates with a locking passage 26 of the housing H through a port 27 for the egress and ingress of fluid during longitudinal movement of the sleeve 30 relative to the housing H. Packings 31 and a packing nut 32 are provided in the chamber 38. The locking passage 26 is a part of a second conduit or locking conduit 23 including the passage 26 terminating in a threaded fitting or inlet socket for attachment of a hose or pipe 23*a* leading to the ground level or surface.

A stop ring 40 is provided which bears against an internal shoulder 41 of the section 12. The stop ring 40 forms one end of an expansible lower chamber 39 between the sleeve 30 and the section 12. The lower chamber 39 communicates through a port 37 with the locking passage 26. An inclined wall 33*a* on the annular collar 34 forms the other end of the chamber 39.

It should be noted, as is evident from the drawings, that the locking chamber 38 forms a larger annular cross-sectional area with the locking piston 36 and the packing nut 32 than the annular cross-sectional area formed in the lower chamber 39 by the inclined wall 33*a* and stop ring 40. Accordingly, fluid pressure in the locking conduit 23 and passage 26 exerts a net downward force on the sleeve 30 by operating across a greater annular cross-sectional area thereof in the locking chamber 38 than in the lower chamber 39.

A packing 42 is positioned between the ring 40 and the threaded end 16 of housing section 13. One or more securing set screws (not shown) may be provided to secure the housing section 13 to the housing section 12.

The upper valve actuating sleeve 30 has a mounting collar 62 (FIG. 1B) mounted to a lower end 30*a* thereof, with an O-ring 62*a* therebetween. A fourth annular chamber 63 is formed between the housing section 13, the mounting coller 62 and a ball-type valve B (FIG. 1B). The collar 62 has an upper surface 65 for engagement with a shoulder 67 on the housing section 13. An annular seat ring 68 formed of rubber, metal, plastic or other suitable material is internally threaded in the collar 62 for sealingly engaging the upstream face of ball valve B.

The collar 62 has four external splines or wings (not shown) in quatrature slidably positioned in corresponding longitudinal grooves in the inner surface of housing section 13, with sector-shaped ridges therebetween which prevent rotation of the sleeve section 30 relative to the housing H.

Slidably received in a slightly enlarged upper portion 74 of the adapter sub 21 is a lower valve actuator sleeve 75 which, at its upper end, bears against the ball valve B.

The lower sleeve 75 has an intermediate external collar 76 extending into a chamber 77 for engagement by a heavy coiled compression spring 77*a* which also engages the adapter 21.

Figure 5:
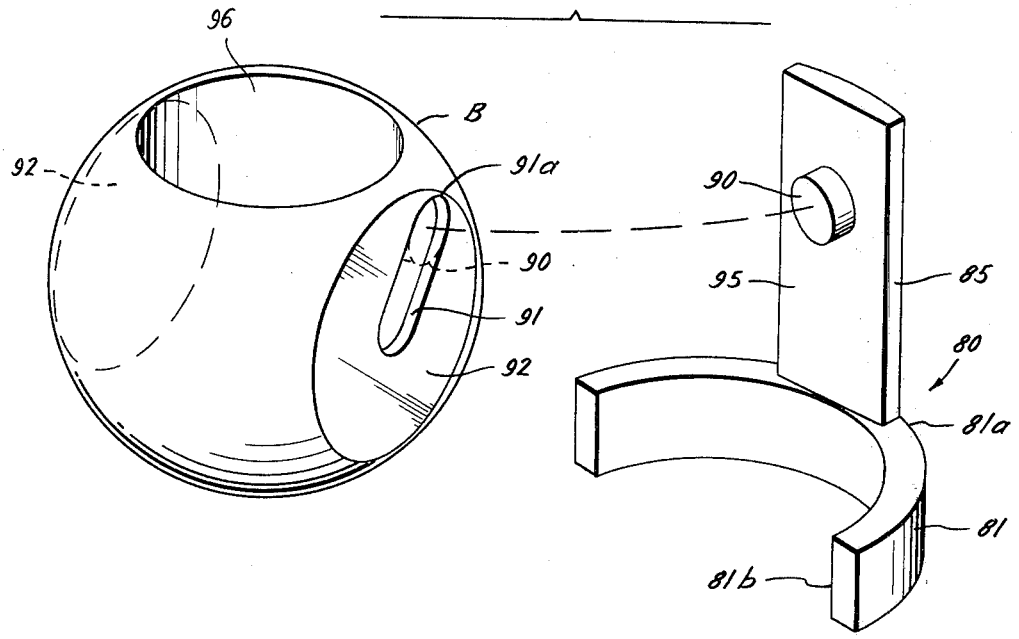
FIG. 5 is an exploded isometric view of the rotatable ball-type valve and valve pivot means of the safety valve of the present invention.
Figure 6:
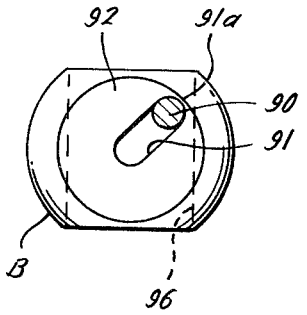
FIGS. 6, 7 and 8 are elevations showing the ball-type valve of FIG. 5 in different operating positions.
Figure 7:
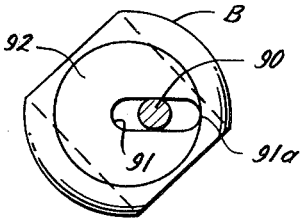
Figure 8:
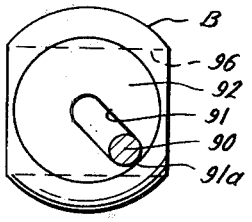

A valve pivot means 80 has a lower collar 81 and an upwardly extending tongue portion 85 (FIG. 5). An outer surface 81*a* of the coller 81 bears against the housing H (FIG. 1B). Two of the pivot means 80 are mounted within the housing section 13 on diametrically opposed sides thereof contacting each other at flat end surfaces 81*b* of the collars 81. A sleeve 78 mounted in the chamber 77 above the adapter sub 21 maintains each of the pivot means 80 in proper position in the housing section 13. The pivot means 80 may be integrally formed with or otherwise suitably mounted with the housing 13 if desired. A set screw may be used to lock and retain the pivot means 80 in position in the housing section 13, if desired. The tongues 85 include inwardly projecting pivot pins 90 (FIGS. 1B and 5) which are received in slots or recesses 91 in a flat side surface 92 formed on diametrically opposed faces of the ball valve B. An end wall 91*a* on the face of the ball valve B retains the pin 90 in the slot 91 and prevents the pin 90 from becoming unseated during movement of the ball valve B. The pivot pins 90 of the valve pivot means 80 slide within the grooves 91 in the surfaces 92 of the valve B and permit rotational movement, as will be set forth below, of the valve B with respect to the housing H from a closed position (FIG. 8) blocking the well tubing to a partially open position (FIG. 7) to an open position (FIG. 6), permitting passage of well fluid through the well tubing. The tongues 85 have complementary flat surfaces 95 abutting the valve surfaces 92 upon which the valve surfaces 92 rotate.

The valve B (FIG. 5) is generally ball shaped with a cylindrical through passage 96 which, in diameter, substantially equals the internal diameter of the valve actuator sections 30 and 75 and also the adapters 17 and 21 which, in turn, have substantially the same internal diameter as that of the conventional tubing string (not shown) connected thereto. In other words, the valve has a full opening when in the open position (FIGS. 2 and 6) for the passage of well tools and for performing well operations therethrough.

In use or operation, the safety valve of this invention is inserted in a production tubing string in a well where it is desired to provide for automatic closing of the well in the event the well pressure should become excessive, indicating possible imminence of a blowout. Normally, the spring 77 urges the lower actuator sleeve 75 upwardly to maintain the valve passage 96 transversely of the flow passage within the sleeves 30 and 75 to thereby position the valve in the closed position (FIGS. 1B). The full force of well pressure then is exerted against the lower face of the ball valve B urging it into sealing contact with the ring 68, the upward movement of which is limited by the engagement of the shoulder 65 with the shoulder 67, so that the flow passage is effectively sealed off.

In order to open the valve, control fluid under pressure is supplied selectively as indicated by an arrow 100 (FIG. 2) from the surface through the operating conduit 22 including operating passage 25 and port 28 and into the expansible operating chamber 29. A net downward fluid pressure is applied to the shoulder 33*b* the inclined shoulder 33 and the seal 34*a* on the operating sleeve 30 to move the operating sleeve 30 downwardly and causes rotation of the ball valve B about the pivot pins 90 from the closed position (FIG. 8) to a partically open position (FIG. 7) and finally to the open position (FIGS. 2 and 6) with the valve passage 96 aligned with the flow passage through the valve actuator sections 30 and 75.

It should be noted that when the control fluid is supplied through conduit 22 to open the valve B, the conduit 25 is not pressurized, creating a pressure differential between the pressurized chambers 29 and the unpressurized chambers 38 and 39, causing the sleeve 30 to move downwardly and engage the valve B and open such valve independently of pressure in the well tubing, permitting use of the safety valve of the present invention at lower depths and with higher tubing pressures and at higher flow rates of fluid through the well tubing.

In the fully open position of the ball valve B, the spring 77 is substantially fully compressed (FIG. 2). Thus, in normal operation of the safety valve of this invention, the ball valve B is held in the open position by the control fluid which overcomes the returning force of the spring 77. To return the ball valve B to the closed position automatically when the well pressure reaches a predetermined point, such well pressure below the ball valve B must be sufficiently high to overcome the control fluid pressure in the chamber 29 and conduit 22. When the control fluid pressure is overcome or offset by the downhole well pressure acting upwardly below the valve B, the compressed spring 77 then acts to move the lower valve actuator sleeve 75 upwardly so that the ball B is rotated about the eccentric pivot pins 90 to rotate the ball valve B from the open position (FIG. 2) to the closed position (FIG. 1B).

When it becomes desirable to lock the ball valve B in the fully open position illustrated in FIG. 2, the pressure in the conduit 22 and chamber 29 is abated. Control fluid under pressure is introduced into the conduit 23 and locking passage 26 in the sleeve 30 from the surface as indicated by the arrows 101 and 101*a* (FIG. 3). The pressure of the control fluid operates across a larger annular surface area in the locking chamber 38 than in the chamber 39, as has been set forth, causing a consequent downward movement of the piston 36 and locking detent 35. Operating sleeve 30 is contacted by the locking detent 35 along the upper surface 33*b* thereof and also moved downwardly. Fluid pressure is maintained in the locking conduit 23, passage 26 and chambers 38 and 39 until the locking piston 36 moves the locking detent 35 adjacent the locking recess 12*a*. The locking detent 35 snaps outwardly against the locking recess 12*a* and engages the surface 33*b* (FIG. 3) preventing upward movement of the sleeve 30 and retaining and maintaining the ball valve B locked in a open position, permitting passage of fluid through the well tubing. Pressure may then be removed from the locking conduit 23 and the ball valve B remains in the locked position (FIG. 3) with the locking piston 36 firmly locking the snap ring 35 in the locking recess 12, retaining the sleeve 30 in position maintaining the ball valve B in the open position.

The safety valve of the present invention is not rendered inoperable in the event of damage or rupture to one of the conduits 22 or 23. Normally, failure of a conduit would cause the subsurface valve to lock in the closed position, requiring removal of the well tubing to replace the inoperable safety valve. With the plural conduits 22 and 23, failure of one of the conduits 22 and 23 does not prevent the introduction of pressure through the other to move the sleeve 30 downwardly. For example, in the event of failure of the conduit 22 or base 22*a* through which control fluid is normally conveyed to the chamber 29 to open the valve B, the conduit 23 is used to convey fluid under pressure to the chambers 38 and 39. The fluid in the chambers 38 and 39 exerts a downward force on the piston 36 and locking detent 35, moving the sleeve 30 The sleeve 30 engages the ball valve B and rotates such valve to the open position, preventing the necessity of shutting in the well to remove such valve to open the well tubing for passage of well fluids therethrough. Similarly, in the event of failure of the conduit 23, control fluid is introduced into the chamber 29 from the conduit 22, moving the sleeve 30 downwardly to engage the ball valve B and rotate the valve B to the open position, opening the well tubing for passage of well fluids therethrough.

The locking means illustrated and described is normally used when it is desired to leave the valve B in the open position (FIGS. 2 and 3) for an extended period of time, and sometimes permanently. Occasionally it is required that the ball valve B be closed even after it has been locked open by the locking means.

Control fluid under pressure is introduced into conduit 22, the passage 25, and through the port 28 and slot 36*b* into the chamer 29, expanding the size of the chamber 29 and moving the piston upwardly to the position illustrated in FIG. 2. The fluid pressure in the chamber 29 retains the locking detent 35 in the locking recess 12*a* and exerts a downward force on the upper surface 33*b* and inclined wall 33 retaining the sleeve 30 and locking the ball valve B open.

Subsequently, the downward fluid pressure in the conduit 22 and passage 25 is abated, permitting the spring 77 to urge the valve pivot means 80 upwardly rotating the ball valve B to the closed position blocking the well tubing. The spring 77 further urges the mounting collar 62 and operating sleeve 30 upwardly, with the upper surface 33*b* of the collar 33 engaging the locking detent 35 and causing contraction and upward movement of such detent.

To facilitate such contraction, the detent ring 35 preferably has an upper tapered annular surface 35*b* which is in contact with a similar tapered suface 12*b* when the locking ring 35 is in the recess 12. Such surfaces permit an inward and upward sliding action of the ring 35, and since the ring is split and has sufficient space 35*b* to contract back to its original diameter so as to fit within the bore of the housing section 12, the upward force thus causes the upward movement of the locking ring detent 35 back to the position shown in FIG. 1A. After the ring detent 35 has thus been released to the unlocked position, normal usage of the valve may take place if it is desired.

It should be understood that an alternate ball-type valve of essentially the same structure as the ball valve B, except that the pins and slots for the pivoting action have been reversed, may be used with the present invention. The movements of the alternate ball valve are the same as heretofore described in connection with the ball valve B, as will be well understood by those skilled in the art.

It should be further understood that alternate structure for mounting the ball valve B with the housing H, such as for example that set forth in my copending U.S. patent application, Ser. No. 72,034, may be used without departing from the scope of the present invention.

The foregoing disclosure and description of the invention are illustrative and explanatory thereof, and various changes in the size, shape and materials as well as in the details of the illustrated construction may be made without departing from the spirit of the invention.

I claim:

1. A method of regulating flow through a well tubing with a subsurface safety valve having a controllable stopper operating independently of the pressure in the tubing comprising the step of:

forming a pressure differential independent of well tubing pressure between first and second expansible control chambers formed by the valve when a greater pressure is selectively introduced in one of either first and second expansible chambers to control the movement of the stopper; and adjusting the position of the stopper in response to the pressure differential between the first and second chambers to enable flow through the well tubing when the greater pressure is selectively introduced into one of either of the first and second expansible chambers.

2. The method of claim 1, further including the steps of:

conveying control fluid to the first expansible control chamber through a first control conduit to control the pressure of the control fluid in the first expansible chamber.

3. The method of claim 2, further including the steps of:

conveying control fluid to the second expansible control chamber through a second control conduit to control the pressure of the control fluid in the second expansible chamber.

4. The method of claim 3, including the steps of:

increasing selectively the pressure of the control fluid in one of either of the first and second conduits to adjust the position of the stopper to enable flow through the well tubing.

5. The method as set forth in claim 2 wherein step of locking includes the step of:

locking the stopper in the open position in a releasable manner by selective use of the second control.

6. The method as set forth in claim 5, including the step of:

releasing the stopper from the locked condition by operation of the first control for enabling subsequent movement of the stopper to a closed position for blocking flow through the well tubing.

7. The method of claim 1, further including the step of:

locking the stopper in an unlockable position to enable flow through the well tubing subsequent to said step of adjusting when the greater pressure is selectively introduced into the second expansible chamber.

8. The method of claim 7, further including the step of:

unlocking the stopper when the greater pressure is selectively introduced into the first expansible chamber to enable subsequent adjusting of the position of the stopper to block flow of fluid through the well tubing.

9. A method of operating a controllable valve having a movable stopper for controlling flow through a well tubing at a subsurface location in the well in response to use of one of first and second controls from the surface to open the valve, comprising the steps of:

moving the stopper to an open position by selective use of one of the first and second controls of the valve at the surface independent of the well tubing for enabling flow to the surface through the well tubing; and locking the stopper in the open position when the second control is selectively used for moving the stopper to the open position.

10. The method as set forth in claim 9, including the step of:

releasing the stopper from the locked condition for enabling subsequent movement of the stopper to a closed position for blocking flow through the well tubing.

11. The method of operating a safety valve having a movable stopper for controlling flow through a well tubing at a subsurface location, comprising the steps of:

moving the stopper to an open position for enabling flow through the well tubing by selective use at the surface independent of the well tubing of one control of a first control and a second control; and locking in an unlockable manner the stopper in the open position when the second control is used to move the stopper to the open position.

12. A method of operating a safety valve having a movable stopper for controlling flow through a well tubing at a subsurface location, comprising the steps of:

moving the stopper to an open position for enabling flow through the well tubing by selective use at the surface independent of the well tubing of one control of a first control and a second control;

locking in an unlockable manner the stopper in the open position when the second control is used to move the stopper to the open position; and unlocking the stopper from the open position with the first control.

13. The method as set forth in claim 12, further including the step of:

moving the unlocked stopper to the closed position to block flow through the well tubing when the use of the first control is ended.

14. The method of claim 12, including the step of:

moving the stopper to the closed position to block flow through the well tubing with the selective use of the first control to move the stopper to the open position is ended.

15. The method of regulating flow through a well tubing with a subsurface safety valve having a controllable stopper comprising the steps of:

forming a pressure differential between first and second expansible control chambers provided by the safety valve independent of the well tubing when a greater pressure is selectively introduced in one of either the first and second expansible chambers; and adjusting the position of the stopper in response to the pressure differential provided by increased pressure in one of either the first and second expansible chambers to enable flow through the well tubing.

16. The method as set forth in claim 15 including the step of:

moving the stopper to enable flow independently of well pressure.

17. The method of claim 15 further including the step of:

conveying control fluid to the first expansible control chamber through a first conduit to introduce control fluid pressure in the first expansible chamber.

18. The method of claim 17 further including the step of:

conveying control fluid to the second expansible control chamber through a second conduit to introduce control fluid pressure in the first expansible chamber.

19. The method of operating from the surface a controllable valve having a movable stopper for controlling flow through a well tubing at a subsurface location, comprising the steps of:

providing a first control having a control conduit communicating to the controllable valve from the surface for operation to move the stopper to the open position for enabling flow through the well tubing;

providing a second control having a control conduit communicating to the controllable valve from the surface for operation to move the stopper to the open position for enabling flow through the well tubing; and operating selectively one of the first and second controls at the surface to move the stopper to the open position to enable flow through the well tubing.

20. The method as set forth in claim 19, including the steps of:

locking the stopper in the open position by operating the valve with the second control; and unlocking the stopper from the locked condition by operation of the valve with the first control.

* * * * *